United States Patent [19]

Brown, Jr.

[11] Patent Number: 4,601,124

[45] Date of Patent: Jul. 22, 1986

[54] APPARATUS FOR INCREASING THE RIGIDITY OF A RIFLE ACTION RECEIVER

[75] Inventor: Edwards Brown, Jr., Phoenix, Ariz.

[73] Assignee: Sturm, Ruger & Company, Inc., Southport, Conn.

[21] Appl. No.: 714,961

[22] Filed: Mar. 21, 1985

Related U.S. Application Data

[63] Continuation-in-part of Ser. No. 462,207, Jan. 31, 1983, abandoned.

[51] Int. Cl.[4] ..... F41C 11/00

[52] U.S. Cl. ..... 42/75.03

[58] Field of Search ..... 42/75 C, 16, 18

[56] References Cited

U.S. PATENT DOCUMENTS

| | | | |
|---|---|---|---|
| 1,376,834 | 5/1921 | Sheppard | 42/75 C |
| 2,611,204 | 9/1952 | Robinson, Jr. | 42/75 C |
| 2,795,881 | 6/1957 | Bellows | 42/75 C |

OTHER PUBLICATIONS

Otteson, S., *The Bolt Action,* Winchester Press, New York, 1976, pp. 84–101.

Otteson, S. and Eaton, J., "The 'Rigid Look' as Built into Bench-Rest Actions", *The American Rifleman,* Dec. 1976, p. 27.

Otteson, S., "The Rigidity of Benchrest Actions", *Rifle,* May–Jun. 1981, p. 24.

*Primary Examiner*—Charles T. Jordan
*Assistant Examiner*—Ted L. Parr
*Attorney, Agent, or Firm*—Don J. Flickinger

[57] ABSTRACT

This relates to a method and apparatus for increasing the rigidity of a conventional pre-existing rifle action receiver of the type which includes a cartridge magazine port having first and second longitudinal edges, an ejection port, and a bolt which reciprocates within the receiver to engage a cartridge and urge it into a chamber at the rearward end of a barrel which is secured into a threaded opening in the front of the receiver. First and second plates are fixedly coupled proximate the first and second edges of the magazine port and extend downwardly therefrom. Rigidity can be further increased by coupling a transverse lateral plate between the first and second plates. Weight and balance can be altered by coupling an insert between the plates.

10 Claims, 12 Drawing Figures

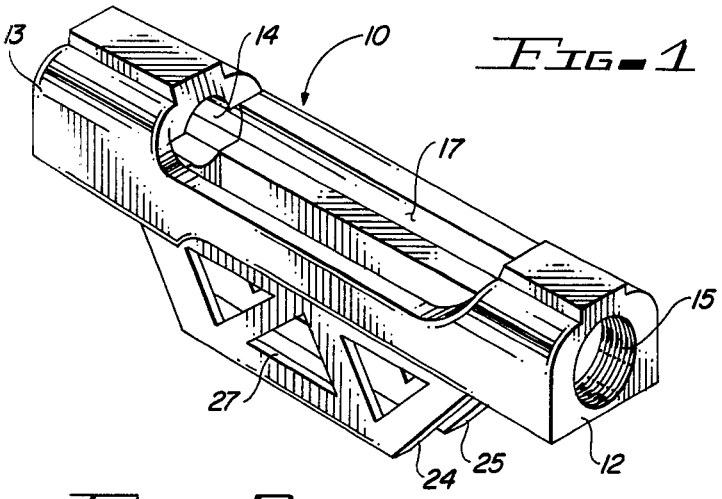
FIG. 1
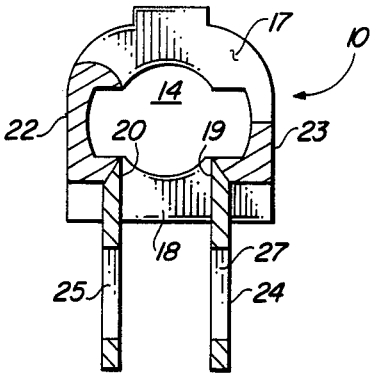
FIG. 3
FIG. 2
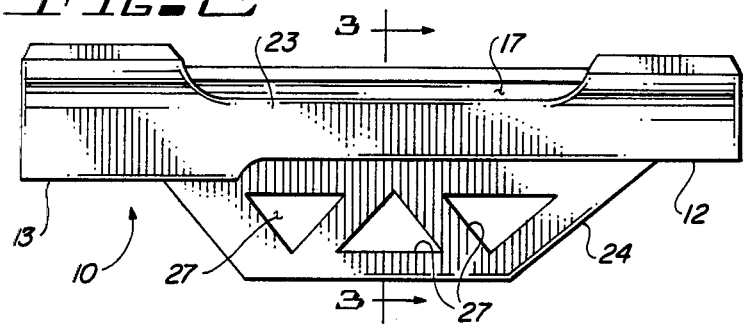
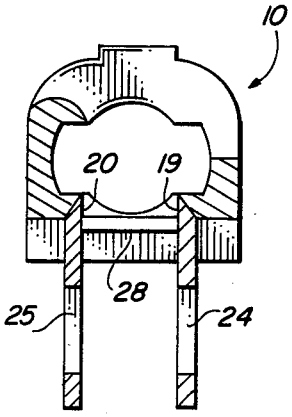
FIG. 5
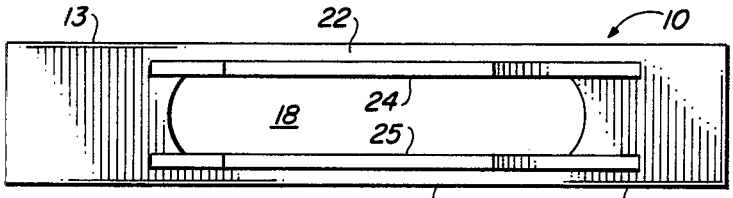
FIG. 4
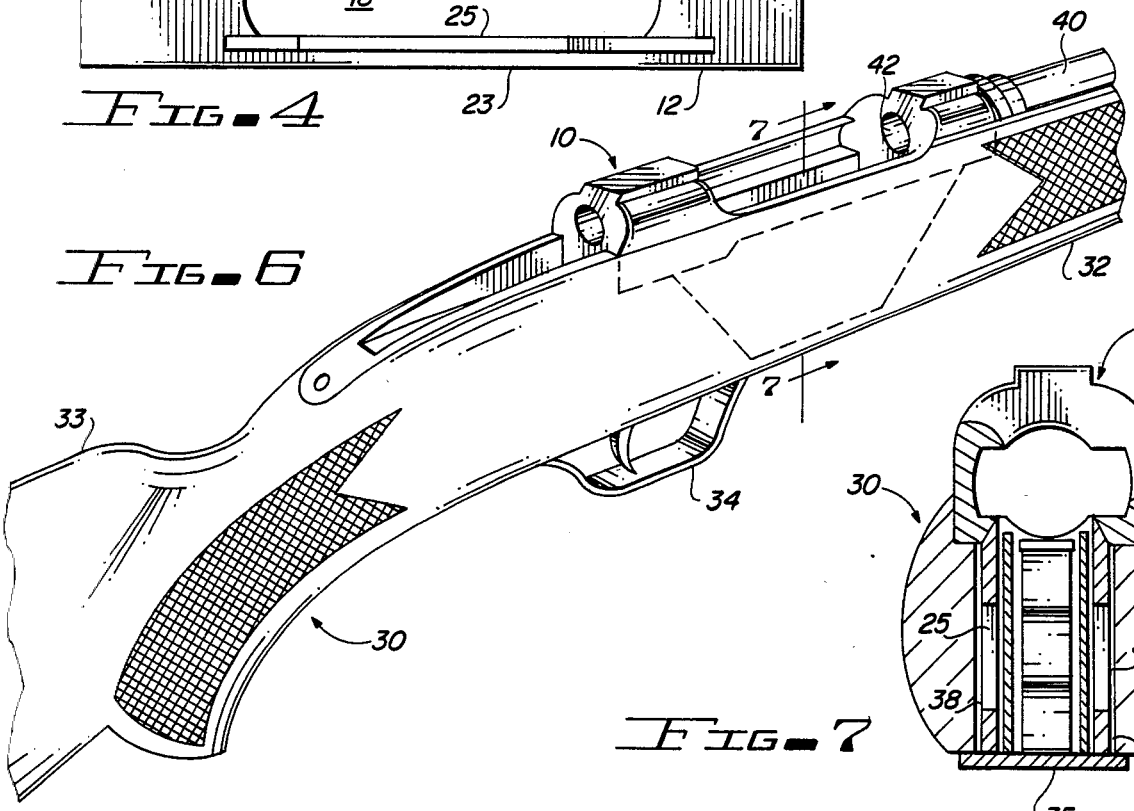
FIG. 6
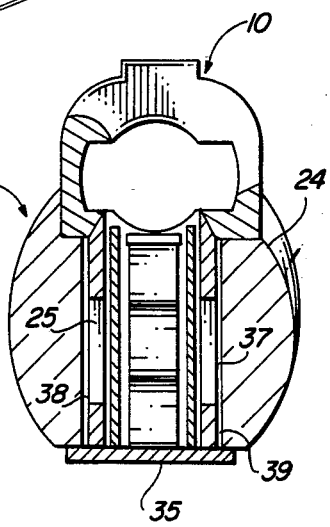
FIG. 7

APPARATUS FOR INCREASING THE RIGIDITY OF A RIFLE ACTION RECEIVER

CROSS REFERENCE TO RELATED APPLICATIONS

The instant application is a Continuation-In-Part of Application Ser. No. 462,207, filed Jan. 31, 1983 now abandoned, entitled Improved Rifle Action.

BACKGROUND OF THE INVENTION

Field of the Invention

This invention relates to firearms.

More particularly, the present invention relates to bolt action type rifles.

In a further and more specific aspect, the instant invention concerns means and method for increasing the rigidity of a rifle action receiver and, therefore, the accuracy of the rifle.

Prior Art

Over the past several decades, the bolt action rifle has achieved eminence as a military weapon and as a sporting arm. Commercially produced by numerous domestic and foreign manufacturers, bolt action rifles are available in various calibers and design configurations. All bolt action rifles, individual variations not withstanding, are analogous.

The typical bolt action rifle, in general similarity to other rifles of diverse character, comprises an action, a barrel and a stock. Peculiarly, the action includes an elongate, tube-like housing referred to as the receiver. A forward receiver ring and a rear receiver ring reside at respective ends of the receiver. A tang, which receives the rear action screw, extends rearwardly from the rear receiver ring. An elongate opening is formed into the upper side of the receiver intermediate the rings. In a repeating type rifle, the opening functions as an ejection port and for manual single loading. A receiver port is formed on the underside of the receiver through which a cartridge can be fed from a magazine.

The rear end of the barrel is affixed, usually threadedly engaged, within the forward receiver ring. A bolt, usually having a radially projecting actuating handle, is reciprocally carried within the receiver for engaging a cartridge and urging the cartridge into a chamber at the rear end of the barrel. The action and barrel assembly are supported upon a stock, typically unitary members extending between a forward portion and a rearward portion, termed the forearm and the butt, respectively. The action is located intermediate the forearm and the butt, with the receiver port in alignment with a magazine opening formed in the stock.

Owing to certain inherent characteristics, the bolt action rifle is favored as a sporting arm. For example, the action operates smoothly and reliably while permitting the construction of a rifle having pleasing lines. The action is also relatively strong. As a result of the interlocking of the bolt with the receiver, the action is able to withstand the pressures generated by modern high power cartridges.

Under field conditions, the weight of a rifle is an exceedingly important factor. Not only must the rifle be carried for extended periods of time, it must be moved quickly, frequently by an arm weary hunter, to track a rapidly fleeing game animal. Capable of being produced in calibers appropriate for large game and yet having a weight frequently of around seven pounds, or even less, the bolt action rifle is ideally suited as a hunting weapon.

The typical bolt action utilized in a conventional field or hunting rifle in meeting the requirement for light weight, however, lacks rigidity. Theoretically the receiver is an elongate generally tubular member. After removal of sufficient material to create the receiver port and the ejection port, the intermediate portion of the receiver is reduced to a pair of side rails of tenuous cross-section. At the crucial time of the firing of the rifle, the rails flex in response to the induced stress thereby enhancing inherent barrel vibrations with attendant loss of accuracy.

The article, "The Rigidity of Benchrest Actions", authored by Stuart Otteson and appearing in the May--June 1981 issue of *Rifle Magazine for Shooters,* discusses the rigidity of various commercial and custom rifle actions and sets forth a method of calculating rigidity. Reference is also made to "The 'Rigid Look' as Built Into Bench-Rest Actions", Stuart Otteson and John Eaton, *The American Rifleman,* December 1976.

Subject to design criteria imposed by individual manufacturers, commercially available bolt actions exhibit wide variance in rigidity. The Winchester Model 70 receiver is fabricated from stock of generally rectangular cross-section, resulting in relatively deep siderails. Being one of the most rigid standard designs, the Model 70 is calculated to have a rigidity number of $1.5\times10^6$. The Remington Model 700 receiver, on the other hand, having a substantially cylindrical cross-section displays a rigidity of $0.5\times10^6$. It is noted that the Winchester receiver weighs approximately 19.3 ounces while the Remington counterpart weighs approximately 15 ounces.

Rigidity values as set forth above are inadequate for certain uses such as varmint hunting and target shooters. Accordingly, various methods have been developed to stiffen and stabilize the receiver. According to one such method, the receiver is encased in an aluminum sleeve. Adding approximately 16 ounces to the weight of the receiver, and blocking off the receiver port thereby imposing single shot limitation, the conversion raises the rigidity of the Remington Model 700 to $3.3\times10^6$.

Another established practice is the custom fabrication of bench-rest actions. Exemplary are the actions produced by Ralph Stolle of Seabrook, Maryland, The Stolle Panda, having a rigidity of $3.9\times10^6$, is an aluminum receiver weighing approximately 41.6 ounces. Another model, the Grissly, machined from steel and weighing approximately 104 ounces, yields a rigidity value of $11.0\times10^6$. Commonly, the actions are of considerable exterior dimensions with a minimum sized ejection port and lacking a magazine opening or receiver port.

It is apparent from the foregoing discussion that the lack of rigidity in a conventional bolt action is a serious limiting factor to ultimate rifle action. A fact well-known to those skilled in the art. Unfortunately, prior art methods to increase rigidity have resulted in expensive receivers of substantially reduced versatility.

It would be highly advantageous, therefore, to remedy the foregoing and other deficiencies inherent in the prior art.

Accordingly, it is an object of the present invention to provide improvements in rifle actions.

Another object of the invention is the provision of improvements especially adapted for use in connection with pre-existing commercially available bolt type actions.

And another object of the invention is to provide means and method for increasing the rigidity of a conventional bolt action.

Still another object of the immediate invention is the provision of means and method for substantially increasing rigidity while only minimally increasing weight.

Yet another object of the invention is to provide rigidizing means which preserve the function and appearance of the action.

Yet still another object of this invention is the provision of means for reinforcing the receivers which are substantially or totally obsecurable by the stock of the rifle.

And a further object of the invention is to provide rigidizing means which include optional means for varying the weight of a rifle.

Still a further object of the instant invention is the provision of stabilizing apparatus which includes a cartridge loading platform.

Yet a further object of the invention is to provide means and apparatus which may be readily practiced as a kit for retrofit to pre-existing action or incorporated into original manufacture.

And a further object of the invention is the provision of means and method, according to the above, which are relatively simple and inexpensive to effectuate.

SUMMARY OF THE INVENTION

According to a broad aspect of the invention, there is provided an apparatus for increasing the rigidity of a conventional pre-existing rifle action receiver of the type which includes a forward receiver ring, a rear receiver ring, a receiver port intermediate said rings for receiving a magazine cartridge and having first and second longitudinal edges, and ejection port, and a bolt which reciprocates within said receiver so as to engage a cartridge and urge the cartridge into a chamber at the rearward end of a barrel which is secured within the forward receiver ring. The receiver is supported by a unitary stock extending continuously between a butt and a foreend and having an intermediate aperture with first and second side surfaces for normally enclosing a cartridge magazine. In accordance with a preferred embodiment of the apparatus, there is provided a first plate fixedly coupled along an edge thereof to the receiver proximate the first longitudinal edge and extending downward adjacent the first side surface of the opening within the stock. Further provided is a second plate fixedly coupled along an edge thereof to the receiver proximate the second longitudinal edge and extending downwardly therefrom adjacent the second side surface of the opening within the stock.

In accordance with a further embodiment thereof, the invention includes a third plate transversely coupled to and extending between the first and second plates. The plate may be positioned so as to permit a cartridge resting thereon to be engaged by the bolt. In accordance with yet another embodiment, the invention includes means for selectively varying the weight of the rifle. More specifically, there is provided an insert having a predetermined weight and sized to be received between the first and second plates. The insert is detachably held in place by attachment means interacting with at least one of the plates. THe insert may further include a loading platform surface to permit a cartridge resting thereon to be engaged by the bolt.

The invention may be practiced as a kit for retrofit to pre-existing rifles. Alternately, the plates may be incorporated into the original manufacture of the receiver.

According to a still further aspect of the invention, there is provided a method for increasing the rigidity of conventional pre-existing rifle action, of the above type, including coupling a first plate along an edge thereof to said receiver proximate said first longitudinal edge and extending downwardly therefrom and coupling a second plate along an edge thereof to the receiver proximate said second longitudinal edge and extending downwardly therefrom.

BRIEF DESCRIPTION OF THE DRAWINGS

The above and other objects, features and advantages of the present invention will be better understood from the following detailed description thereof, taken in conjunction with the accompanying drawings, in which:

FIG. 1 is a perspective view of a conventional receiver as it would appear when improved in accordance with the teachings of the instant invention;

FIG. 2 is a side view of the receiver shown in FIG. 1;

FIG. 3 is a vertical sectional view of the receiver taken along the line 3—3 of FIG. 2;

FIG. 4 is a bottom plan view of the receiver seen in FIG. 1;

FIG. 5 is a view generally corresponding to the view of FIG. 3 and showing an alternate embodiment of the instant invention;

FIG. 6 is a partial perspective view of a rifle of a single and continuous stock variety having the improved receiver of the instant invention embedded therein;

FIG. 7 is a vertical sectional view taken along the line 7—7 of FIG. 6;

DETAILED DESCRIPTION OF THE PREFERRED EMBODIMENTS

Figure 8:
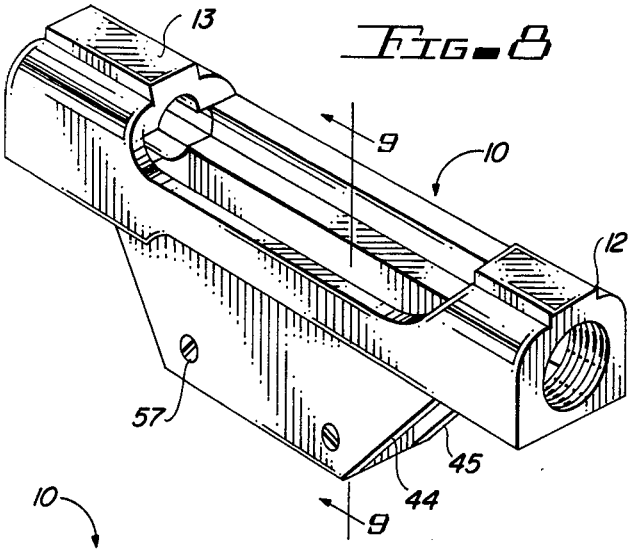
FIG. 8 is a perspective view of the receiver of FIG. 1 incorporating an alternate embodiment of the instant invention.

Turning now to the drawings in which like reference characters indicate corresponding elements throughout the several views, attention is first directed to FIG. 1 which shows a rifle action receiver 10 having forward receiver ring 12 and rear receiver ring 13. Bore 14 extends longitudinally through receiver 10. Threaded aperture 15 within forward receiver ring 12 receives a barrel (not shown).

With further reference to FIGS. 2, 3 and 4, it is seen that receiver 10 further includes an ejection port 17 extending between forward receiver ring 12 and rear receiver ring 13. A receiver port or magazine port 18 having first and second longitudinal edges 19 and 20 also resides intermediate the rings 12 and 13. Magazine port 18 resides on the underside of receiver 10. Ejection port 17 is substantially opposite magazine port 18, residing on the upper side of receiver 10. Remaining between forward receiver ring and rear receiver ring 13 are side rails 22 and 23.

Receiver 10 is intended to be representative of the typical receiver used in conventional bolt action rifles which are commercially produced by numerous domestic and foreign manufacturers. The brief, foregoing description is set forth for purposes of orientation and understanding in connection with the ensuing detailed description of the instant invention. For purposes of clarity of illustration, various details and components of the action have been omitted. For example, the magazine or receiver port receives the upper end of a cartridge holding magazine. A cartridge receiving chamber is formed in the rear end of the barrel within the forward receiver ring. A bolt, usually rotationally and reciprocally carried within the receiver, engages a cartridge from the magazine and inserts the cartridge into the chamber. The bolt is also capable of extracting the cartridge from the chamber for discharge through the ejection port. The foregoing and other details not specifically illustrated and design characteristics peculiar to a given manufacturer will be readily appreciated to those skilled in the art.

In accordance with the immediate invention, a pair of spaced apart plates 24 and 25 are fixedly coupled to the under side of the receiver proximate edges 19 and 20, respectively, and extend downwardly therefrom in parallel relationship to each other. The plates may be generally trapezoidal in shape, being secured to the receiver by the longer one of the parallel edges. Preferably, each plate is of sufficient length to have forward and rearward terminal portions affixed to the forward receiver ring and the rear receiver ring, respectively. Plates 28 and 30 may be manufactured from, for example, steel, brass, titanium, aluminum, etc. and may be secured to the receiver by any convenient normal metal working technique such as welding, brazing or soldering.

A plurality of openings 27 extend through each plate 24 and 25 for the purpose of reducing weight. In the immediately preferred embodiment, the openings are generally triangular and placed in a regular pattern whereby each plate generally assumes the characteristics of a truss. Alternately, the openings may be of other forms, such as circular, and placed in a desired pattern. It is also within the teachings of the instant invention, that the plates are solid.

It has been determined that the addition of plates 24 and 25 to a conventional, commercially available receiver substantially increases rigidity. For purposes of experimentation, solid plates of the above described character were added, in the manner described above, to a selected commercially available receiver. The receiver, as supplied by the manufacturer, had a rigidity which was calculated to be $0.27\times10^6$. The addition of the plates raised the rigidity to $7.4\times10^6$. It is seen therefore that the addition of the plates, each of which weighed only approximately 3 ounces, increased the rigidity slightly more than 27 times.

With reference to FIG. 5, there is seen a second embodiment of the invention wherein the rigidity is even further increased due to a transverse lateral plate 28 which is fixedly coupled between vertical plates 24 and 25. Furthermore, plate 28, when properly positioned, serves as a loading platform such that a cartridge placed thereon will be engaged by the bolt and urged into the rifle's chamber.

One of the distinct advantages of the inventive receiver is illustrated in FIGS. 6 and 7. That is, when the inventive receiver is used in connection with a rifle having a single piece stock 30 extending continuously between butt 33 and forearm 32 and having a trigger assembly 34, plates 24 and 25 may be inserted downwardly into stock 30 and hidden thereby. The cartridge magazine 35 is then inserted between plates 24 and 25 as is shown in FIG. 7. Thus, rigidity has been increased without detracting from the overall appearance of the weapon.

In the construction of a conventional bolt action rifle having a single and continuous stock, the magazine or receiver port is in substantial alignment with the magazine opening in the stock. In practicing the instant invention, it may be necessary to slightly widen the magazine opening in order to accomodate the plates 24 and 25. As particularly seen in FIG. 7, plates 24 and 25 extend within stock 30 in substantial juxtaposition to the respective side walls 37 and 38 of the magazine opening 39. Magazine 35 is received therebetween. For purposes of further orientation, additional reference is made to FIG. 6 in which is seen barrel 40 engaged within threaded opening 15 and presenting firing chamber 42 within forward receiver ring 12.

Figure 9:
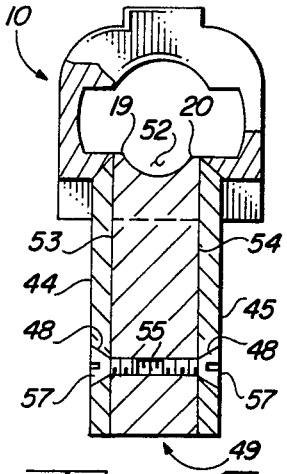
FIG. 9 is a vertical sectional view taken along the line 9—9 of FIG. 8.
Figure 10:
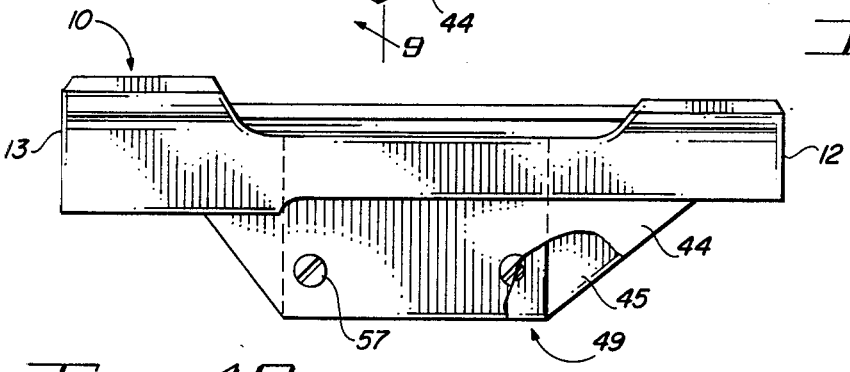
FIG. 10 is a side view of the receiver shown in FIG. 8.

Turning now to FIGS. 8, 9 and 10, there is seen yet another embodiment of the invention in which plates 44 and 45 are affixed to receiver 10. Plates 44 and 45 are generally analogous to previously described plates 24 and 25, respectively, and are affixed to receiver 10 as set forth above. Plates 44 and 45 deviate from the previously described plates by virtue of countersunk apertures 48. In accordance with the immediately preferred embodiment of the invention, two such openings are formed in each plate. Further provided is an insert generally designated by the reference character 49.

Figure 11:
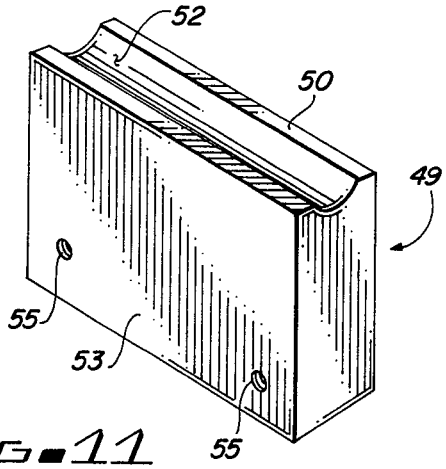
FIG. 11 is a perspective view on an enlarged scale of the insert seen in the embodiment of FIG. 8.

In accordance with the immediately preferred embodiment, insert 49 is in the form of a generally rectangular block sized to be received between plates 44 and 45, as better seen in FIG. 11. Top 50 includes a longitudinally extending recess 52 which functions as a loading platform. Sides 53 and 54 reside in substantial juxtaposition with plates 44 and 45, respectively. Attachment means for securing insert 49 includes threaded apertures 55 extending inwardly from sides 53 and 54 and receiving flathead machine screws 57 extending through countersunk apertures 48.

Insert 49, in similarity to lateral plate 28, further increases rigidity and provides a loading platform. Additionally, insert 49 functions to increase the weight of the rifle when desired. Accordingly, a previously reinforced, lightweight hunting rifle may be converted into a target rifle when desired. Insert 49 may be readily fabricated of various materials of differing weights, such as aluminum, steel or brass. Accordingly, the optional weight may be selectively varied to achieve the balance desired by the individual shooter.

Figure 12:
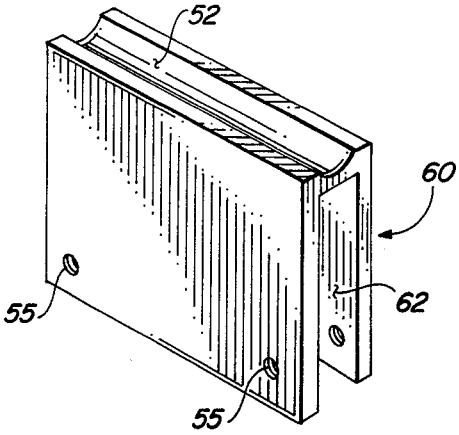
FIG. 12 is a perspective view of another insert usable in connection with the embodiment seen in FIG. 8.

Another means for adding selectively variable weight is the use of alternate insert 60 as seen in FIG. 12. In common with previously described insert 49, insert 60 is sized to be received between plates 44 and 45 and includes recess 52 and threaded apertures 55. A portion 62 has been removed such that insert 60 weighs less than insert 49. The overall weight of insert 60 is directly proportional to the size of the cavity or portion 62. A series of inserts of varying weights may be be provided.

Various changes to the embodiments herein chosen for purposes of illustration will readily occur to those skilled in the art. For example, the invention has been described in terms of a kit suitable for retrofit to pre-existing rifles already in the hands of users. It is within the scope of the invention that the improvements may be practiced by the manufacturer as original equipment. Further, the elements of the invention are subject to wide variation in shape and design, it being inderstood that the specific configurations were chosen for purposes of illustration. To the extent that such modifications and variations do not depart from the spirit of the invention, they are intended to be included within the scope thereof which is assessed only by a fair interpretation of the following claims.

Having fully described and disclosed the instant invention, and alternate embodiments thereof, in such clear and concise terms as to enable those skilled in the art to understand and practice the same.

The invention claimed is:

1. In a rifle of the type which includes a unitary stock extending continuously between a butt and a foreend having an intermediate aperture with first and second side surfaces for normally enclosing a cartridge magazine;

a receiver supported by said stock and having a forward receiver ring, a rear receiver ring, a receiver port of a first length and having first and second longitudinal edges intermediate said rings and in substantial alignment with the aperture in said stock, and an ejection port intermediate said rings; and a bolt reciprocally movable within said receiver for normally engaging a cartridge from said magazine and urging said cartridge into a chamber within said forward receiver ring, improvements therein for increasing the rigidity of said action, said improvements comprising:

a. a first plate having a length greater than said first length and bonded along an edge therof to said first longitudinal edge, said forward receiver ring, and said rear receiver ring, and extending downwardly therefrom adjacent said first side surface;

b. a second plate having a length greater than said first length and bonded along an edge thereof to said, second longitudinal edge, said forward receiver ring, and said rear receiver ring, and extending downwardly therefrom adjacent said second side surface.

2. The improvements of claim 1, further including a third plate transversely coupled to and extending between said first and second plates.

3. The improvements of claim 2, wherein said third plate is positioned as to permit a cartridge resting thereon to be engaged by said bolt.

4. The improvements of claim 1, further including means coupled to at least 1 of said first and second plates for selectively varying the weight of said rifle.

5. The improvements of claim 4, wherein said means for selectively varying the weight of said rifle includes:

a. an insert having a pre-determined weight and sized to be received between said first and second plates; and b. attachment means for securing said insert to at least one of said first and second plates.

6. The improvements of claim 5, wherein said insert includes:

a. a first side for being received adjacent said first plate; and b. a second side for being received adjacent said second plate.

7. The improvements of claim 5, wherein said insert includes a loading platform surface to permit a cartridge resting thereon to be engaged by said bolt.

8. The improvements of claim 1, wherein said first and second plates are concealed by said stock.

9. A method for increasing the rigidity of a conventional pre-existing rifle action receiver of the type which includes a forward receiver ring, a rear receiver ring, a receiver port, having a first length and having first and second longitudinal edges for receiving a cartridge magazine, an adjacent port, a bolt which reciprocates within said receiver authorized to engage a cartridge and urge it into a chamber at a front wall of said receiver, comprising;

bonding a first plate having a length greater than said first length along an edge thereof to said first longitudinal edge, said forward receiver ring and said rear receiver ring, and extending downward therefrom; and bonding a second plate having a length greater than said first length along an edge thereof to said second longitudinal edge, said forward receiver ring and said rear receiver ring, and extending downward therefrom.

10. A method according to claim 9 further comprising coupling a third plate to and between said first and second plates and transversely thereto.

* * * * *